US005164695A

United States Patent [19]

Monson et al.

[11] Patent Number: 5,164,695

[45] Date of Patent: Nov. 17, 1992

[54] INTERLOCKED CONTACTOR ASSEMBLY

[75] Inventors: Donald B. Monson, Eastover; Spaso Nocilo, Columbia, both of S.C.

[73] Assignee: Square D Company, Palatine, Ill.

[21] Appl. No.: 590,384

[22] Filed: Sep. 28, 1990

[51] Int. Cl.[5] ..... H01H 9/02

[52] U.S. Cl. ..... 335/202; 361/337; 200/50 A

[58] Field of Search ..... 335/167-176, 335/202; 361/334-335, 337-339, 343-345; 200/50 A, 330, 337

[56] References Cited

U.S. PATENT DOCUMENTS 4,090,230 5/1978 Fuller et al. .
4,598,183 7/1986 Gardner et al. .
4,612,424 9/1986 Clark et al. .

*Primary Examiner*—Lincoln Donovan
*Attorney, Agent, or Firm*—Michael J. Femal; Hugh M. Gilroy

[57] ABSTRACT

The interlocked contactor includes an interlock mechanism which selectively prevents closure of contactor contacts before a preselected number of operations of the contactor. An armature actuator is connected to the armature to cause a slider bar portion of the interlock mechanism to translate between an interlock open and interlock closed position corresponding to the contact open and contact closed positions. The interlock mechanism is generally mounted to a detachable mounting base which is mounted to a contactor frame. The slider bar is positionally maintained before failure of the assembly by a pair of roller carrying studs, one of which is designed to shear before the predetermined number of contactor operations. An arresting base is pivotally mounted for movement about one of the studs providing adjustable alignment with the slider bar. An adjustment shaft determines the degree of clearance between an interlock tab on the arresting base and an arresting notch on the slider bar. The armature actuator rides within a translating notch of the slider bar. When both studs are in an unfailed condition, they cause the slider bar to only translate as a result of the movement of the armature actuator. On failure of one of the studs, the slider bar both rotates and translates causing the arresting notch to receive the interlock tab when the contactor attempts to close.

19 Claims, 5 Drawing Sheets

Fig. 3
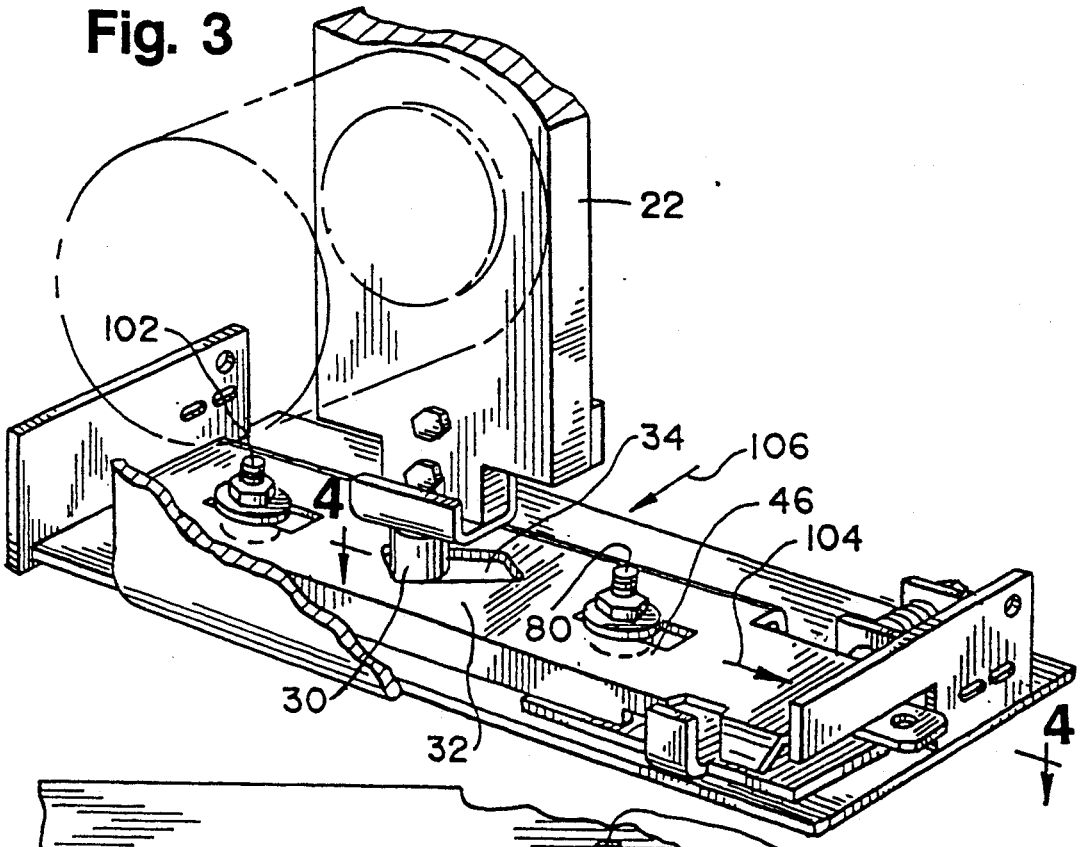
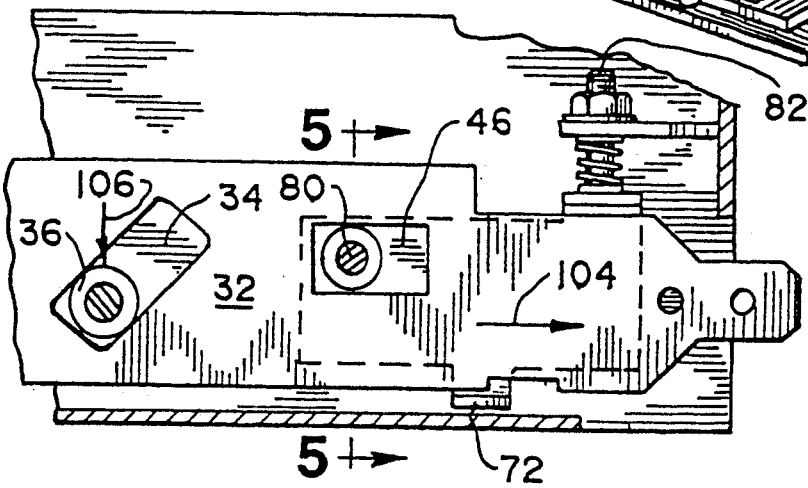
Fig. 4
Fig. 5
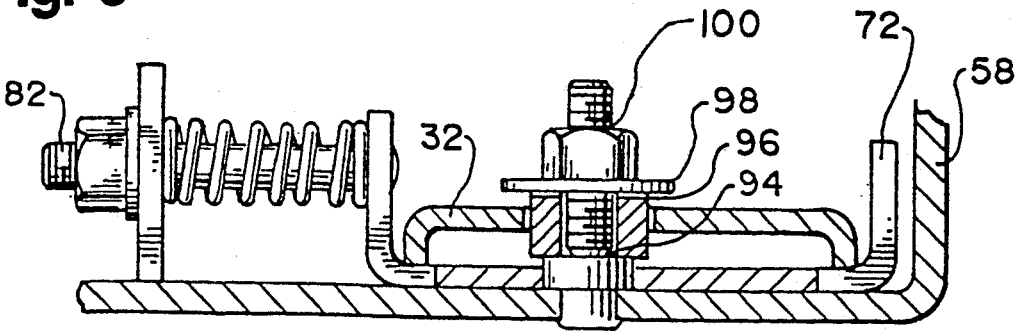

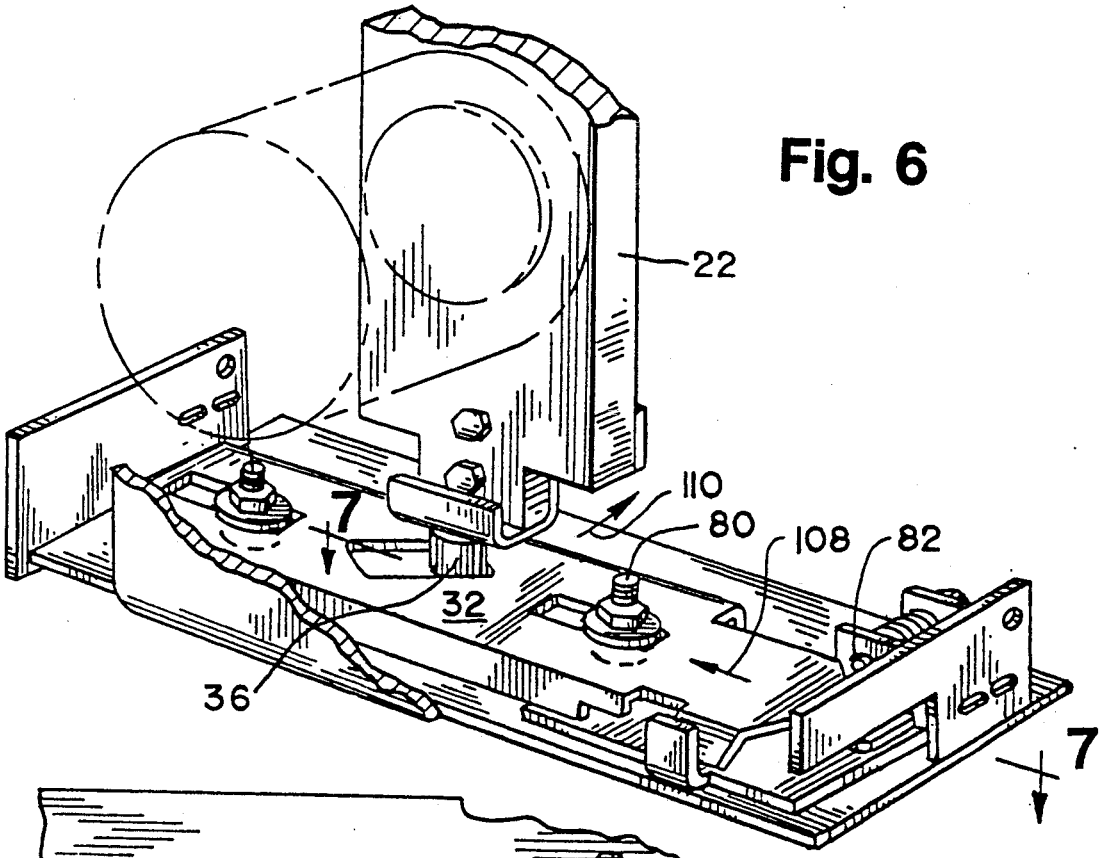
Fig. 6
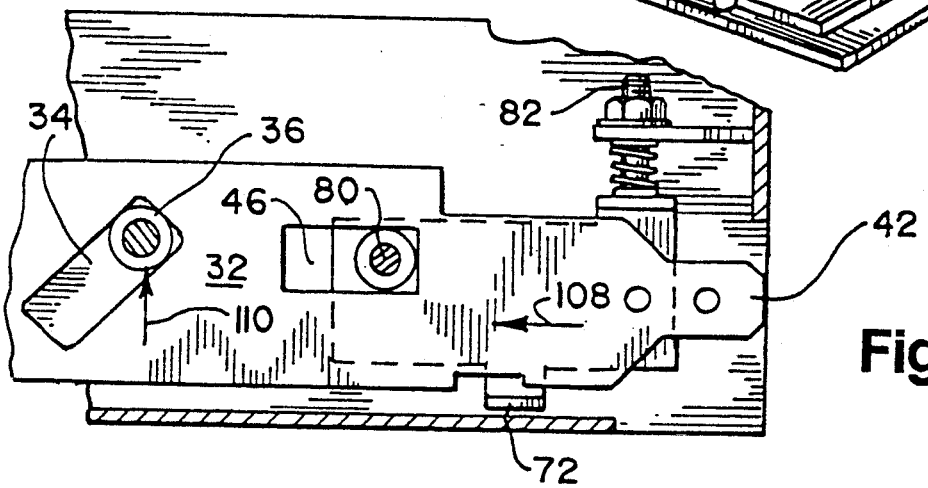
Fig. 7
Fig. 8
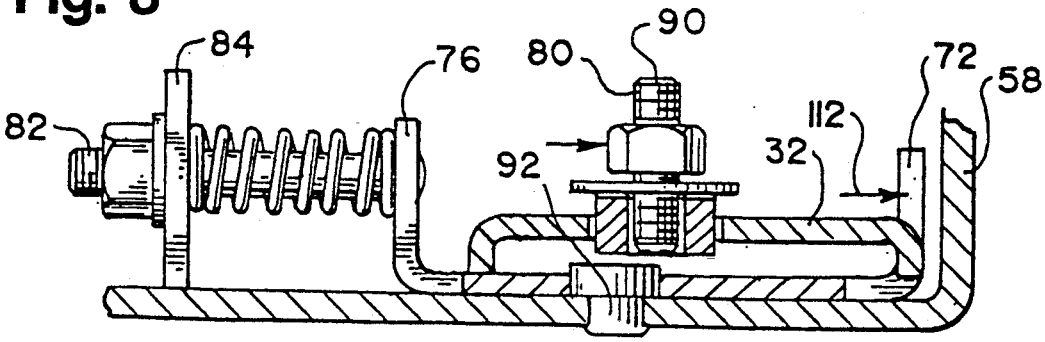

INTERLOCKED CONTACTOR ASSEMBLY

BACKGROUND OF THE INVENTION

The present invention relates to in plant power distribution centers such as motor controllers and particularly relates to operating mechanisms for contactor assemblies which are interlocked. Most particularly the invention deals with interlocked mechanisms used to prevent closure of contactor assemblies under certain conditions.

Motor controllers having interlocked contactor assemblies are known in the art for a large variety of both interlock functions and interlock mechanisms to achieve those interlocked functions. Often in a motor control center, the motor control center will include a contactor capable of making and breaking the normal design motor loads and a hand actuated disconnect switch which interrupts the power supply to the contactor under an essentially no load condition. Either the contactor or the disconnect switch may be interlocked with a door to a sheet metal enclosure of the motor control center to prevent the opening of the door when power is supplied to the load or the contactor or both. When the contactor is supplied power through a disconnect switch which is only capable of disconnecting the power mains under essentially a no load condition, the disconnect switch is usually prevented from opening by a interlock mechanism between the contactor and the disconnect switch which prevents the switch from opening when the contactor contacts are closed. These mechanisms are subject to considerable stress as a result of the contactor closing and opening, and as a result the desired interlock function can degrade over time.

Among the publications relating to operating mechanisms are the following typical U.S. Patents assigned to the assignee of the present invention Square D Company.

U.S. Pat. No. 4,612,424 issued to Michael R. Clark et al on Sep. 16, 1986 describing a DOOR MOUNTED CIRCUIT BREAKER OPERATING APPARATUS.

U.S. Pat. No. 4,598,183 issued to Jeffrey B. Gardner et al on July 1, 1986 describing a TRIP INDICATING CIRCUIT BREAKER OPERATING HANDLE.

U.S. Pat. No. 4,090,230 issued to Frederick B. Fuller et al on May 16, 1978 describing a HIGH VOLTAGE MOTOR STARTER ENCLOSURE.

SUMMARY OF THE INVENTION

The interlocked contactor assembly of the present invention includes a contactor frame, contacts, an armature and an armature actuator. The contacts have open and closed positions as do other portions of the assembly. Interlock means selectively prevents movement of the armature from an armature open position to an armature closed position. Arresting means selectively prevents movement of the interlock means from an interlock open position to an interlock closed position. Selective adjustable alignment means for aligning the interlock means and the arresting means and for failing before a predetermined number of contactor operations prevents the interlock means from moving from an interlock open position to an interlock closed position on failure of the adjustable alignment means.

BRIEF DESCRIPTION OF THE DRAWINGS

FIG. 3 is a perspective view in partial cross section of a portion of the present invention with components shown in the closed position.

FIG. 4 is a cross section view of a portion of FIG. 3.

FIG. 5 is a cross section view of a portion of FIG. 4.

FIG. 6 is a perspective view along lines similar to FIG. 3 of the present invention showing components in the open position.

FIG. 7 is a partial sectional view of the present invention from FIG. 6.

FIG. 8 is a view similar to that of FIG. 5 showing components in a failed position.

DETAILED DESCRIPTION OF THE DRAWING

Figure 1:
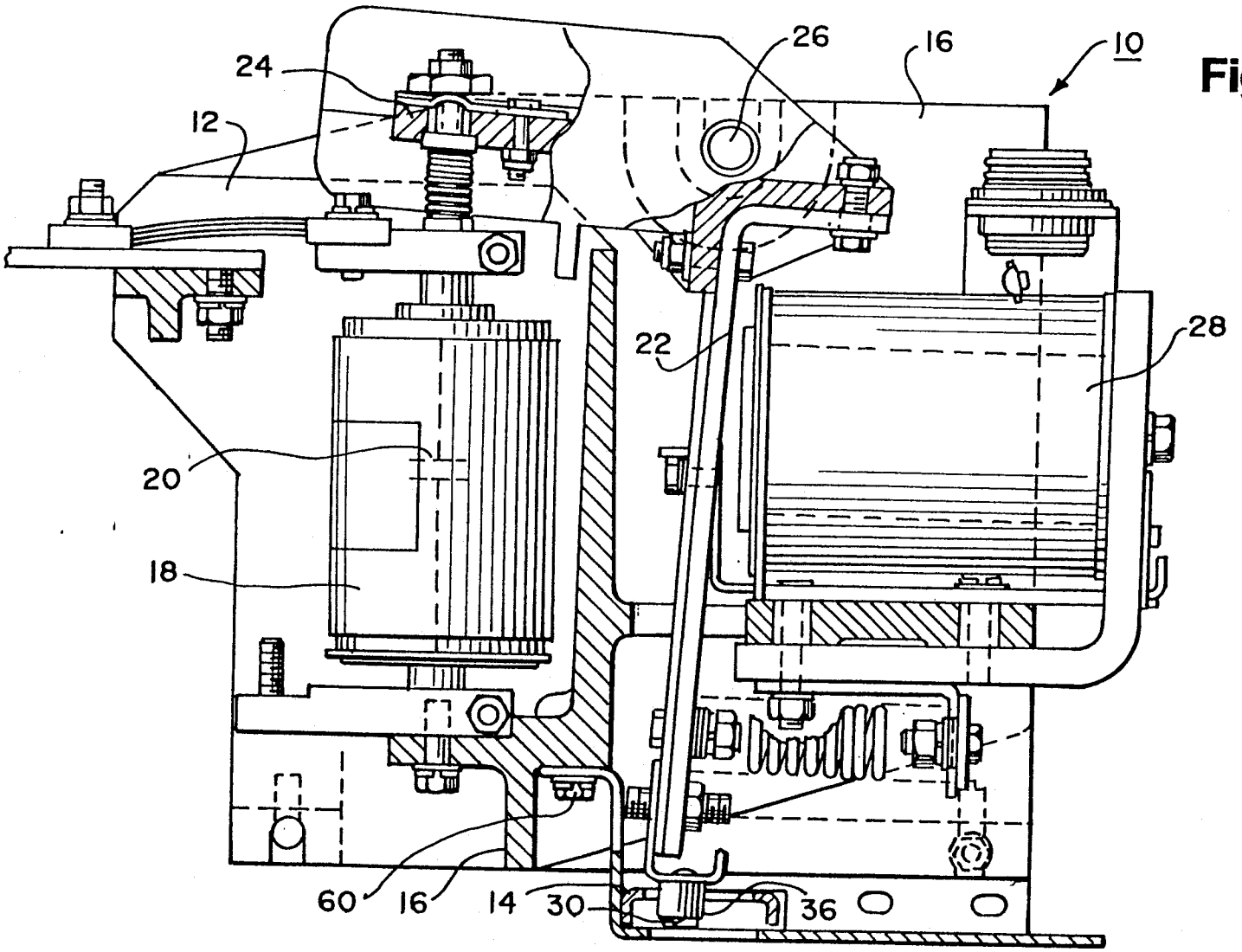
FIG. 1 is a left side view in partial cross section of the interlocked contactor assembly of the present invention.

FIG. 1 shows a left hand view in partial cross section of the interlocked contactor assembly 10 of the present invention. The contactor assembly 10 of the present invention can be thought of as including two principle components, that of the contactor 12 and that of the interlock mechanism 14. Contactor 12 includes a contactor frame 16 which generally provides support for the remaining components of the contactor assembly 10. The contactor illustrated is of the vacuum bottle type and includes vacuum bottle 18 which maintains a vacuum about contactor contacts 20 symbolically shown in phantom in FIG. 1 in an opening position. Contact 20 is operatively connected to armature 22 via contact arm 24 pivotally mounted about contactor hinge 26. The state of energization of coil 28 causes armature 22 to assume an armature closed position, or an armature open position, respectively corresponding to a contact open position, preventing conduction of current to a load, or a contact closed position, allowing current to be conducted to a load. Each movement of contact 20 between open and closed positions can be regarded as a contactor operation.

Armature actuator 30 is part of interlock mechanism 14 and interfaces with slider bar 32 by riding within translation notch 34. Armature actuator 30 includes a stud mounted actuator roller 36 having a diameter somewhat less than the width of translation slot 34. Roller 36 is fabricated from powdered metal and permanently lubricated as are other rollers of this invention.

Figure 2:
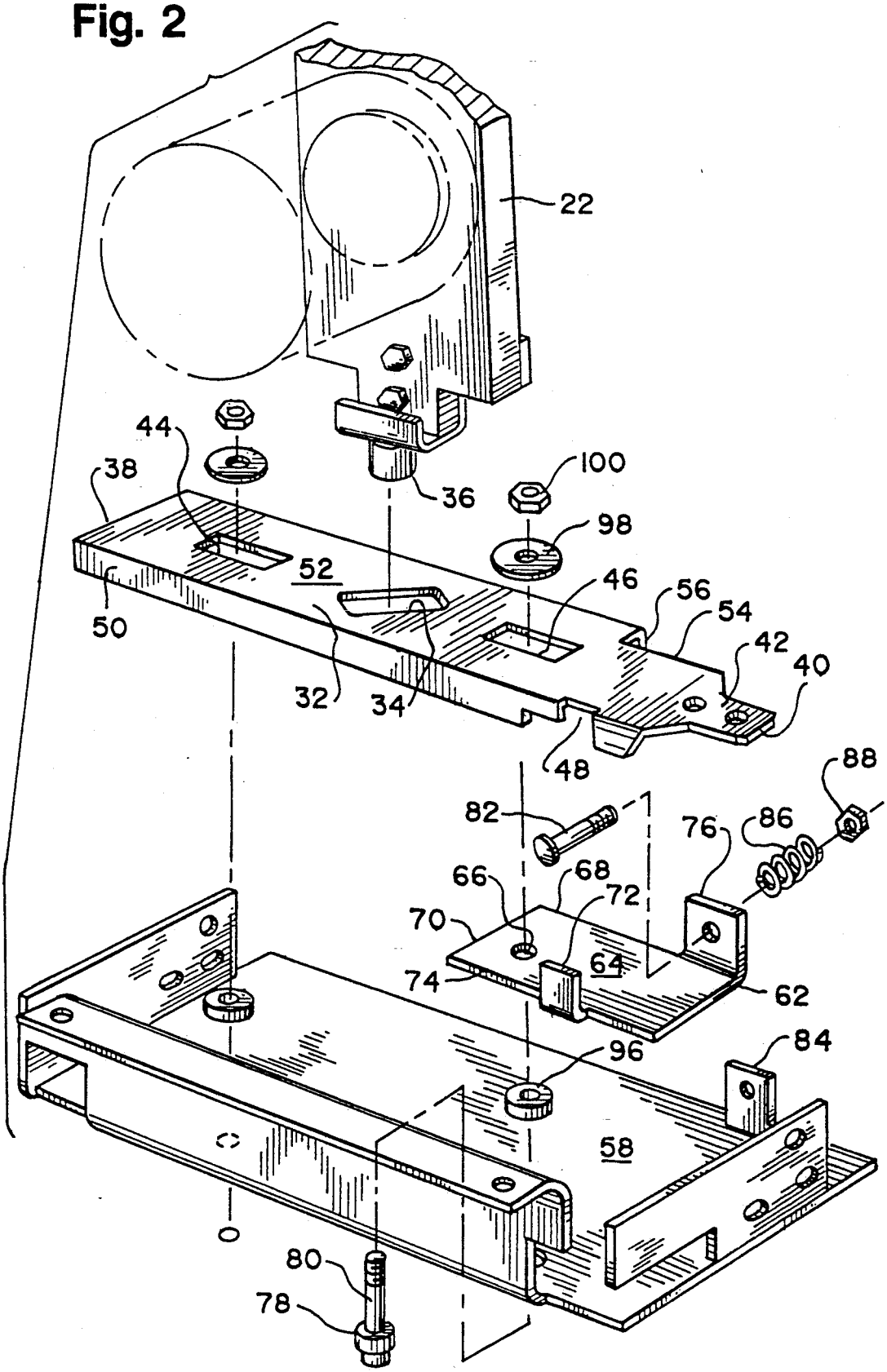
FIG. 2 is a left rear perspective of an exploded view of a portion of the present invention in partial cross section.

As shown in FIG. 2, slider bar 32 is generally of a U-shape cross section having a distal end 38 and a nose end 40. Adjacent to nose end 40 is nose 42 which can be connected with an unshown mechanical linkage to prevent or allow the opening or closing of an associated disconnect switch, unshown, or an unshown door of a metal enclosure. Slider bar 32 further defines a distal notch 44 between translating notch 34 and distal end 38. Similarly nose notch 46 lies between translation notch 34 and nose end 40. Both distal 44 and nose 46 notches are aligned with the elongation of slider bar 32 unlike translation notch 34 which assumes approximately a forty-five degree angle between its axis of elongation and the axis of elongation of slider bar 32. As a result of the forty-five degree orientation of translation notch 34, it acts as translation means for causing slider bar 32 to move with more than one degree of freedom on failure of adjustable alignment means. The axes of elongation of distal notch 44 and nose notch 46 substantially coincide with that of slider bar 32. Approximately midway between nose notch 46 and nose 42 is arresting notch 48 formed by removing a portion of back leg 50 from the U-shape of slider bar 32. Similarly, approximately opposite arresting notch 48, clearance 54 removes a portion of slider base 52 and front leg 56. Slider bar 32 slides on legs 50 and 56 on detachable mounting base 58 removably attached to contactor frame 24 by mounting bolts 60.

Between slider bar 32 and base 58 is arresting plate 62 being a generally rectangular flat arresting base 64 having an arresting pivot structure 66 adjacent to a corner of base 64 formed by the front 68 and right 70 edges of arresting base 64. Arresting tab 72 rises from rear edge 74 of arresting plate 64. An arresting abutment 76 protrudes upwardly from front edge 68.

Pivot structure 66, here shown as a hole, receives shoulder 78 of shearable nose stud 80. Arresting plate 62 may pivotally swing about shoulder 78 of stud 80 which is mounted into base 58. A threaded adjustment shaft 82 extends between arresting abutment 76 and base abutment 84 to pivotally adjust the position of arresting plate 62. Adjustment spring 86 surrounds shaft 82 between abutments 76 and 84. Adjustment lock nut 88 is received on shaft 82 to the opposite side of base abutment 84 to adjust the distance between abutments 76 and 84 and the clearance between interlock tab 72 and arresting notch 48. Preferably adjustment nut 88 is of the locking variety with a nylon insert to maintain an adjustment once made.

Stud 80 is roughly divided into two parts, threaded stud portion 90 above shoulder 78 and shoulder stud portion 92. A circumferential groove 94 is inscribed in threaded stud portion 90 immediately adjacent to shoulder 78. The circumferential groove 94 is a designed weakening of stud 80 to cause it to fail in shear before a predetermined number of contactor operations. A stud roller 96 is received on an unthreaded portion of threaded stud portion 90 and secured in place by a stud washer 98 and lock nut 100. Stud roller 96 on nose stud 80 rides within elongate nose notch 46 to guide the movement of slider bar 32. Similarly, towards distal end 38 a distal stud 102 has the same associated structure as nose stud 80 (absent the circumferential groove 94) and provides guidance to slider bar 32 via roller 96 which rides within elongate distal notch 44. Studs 80, 102 with associated structure act as first and second orientation means guiding the movement of slider bar 32.

The cooperation among components and functions associated with interlocked contactor assembly 10 of the present invention may be most readily grasped by an examination of FIGS. 3 through 10.

FIGS. 3 through 5 illustrate the components of the invention with the components being in their closed position. This position may be most readily apparent by the degree of protrusion of nose 42 of slider bar 32 where it may interface with other mechanisms positively preventing their operation when current is being carried through contact 20 in the closed position.

FIGS. 6 and 7 show components of contactor assembly 10 in the open position.

Figure 9:
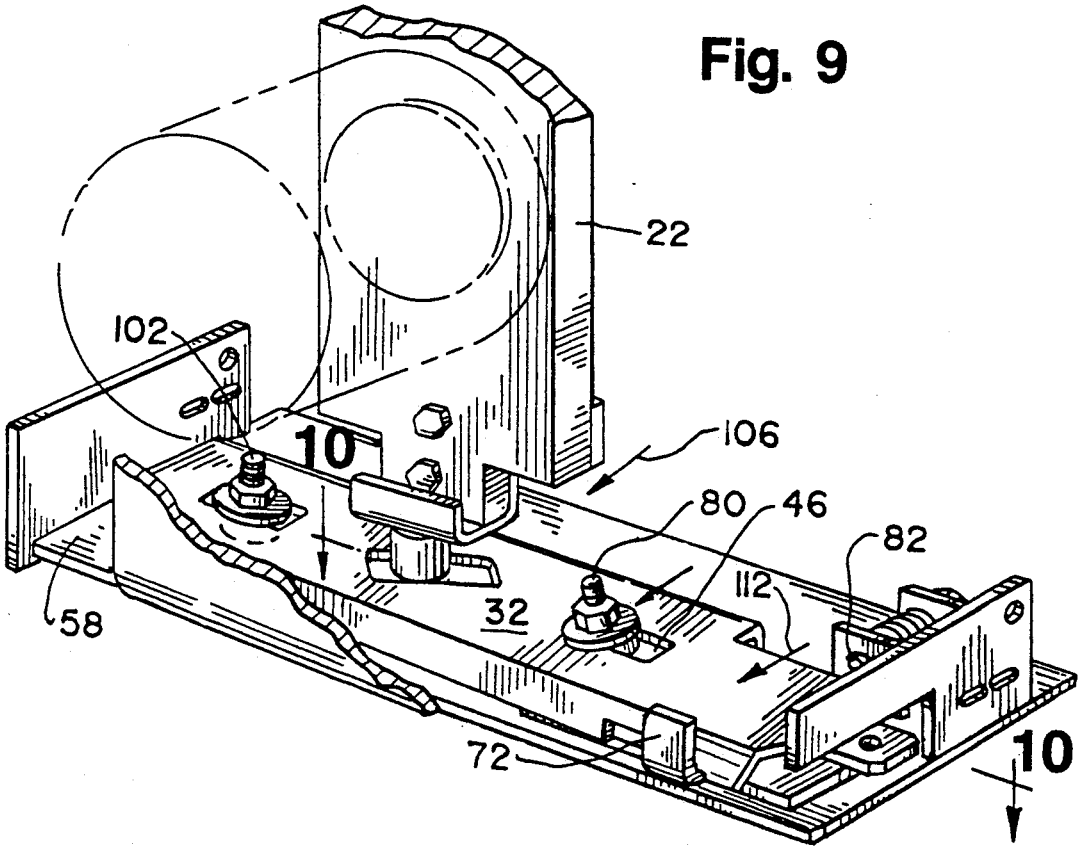
FIG. 9 is a perspective view similar to that of FIGS. 3 and 6 showing the interlocked contactor assembly of the present invention between open and closed positions in a designed failure condition.
Figure 10:
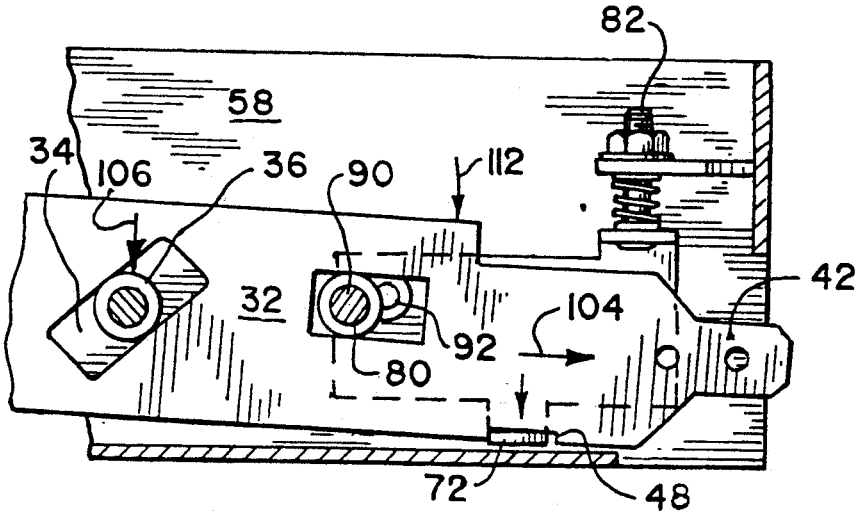
FIG. 10 is a partial cross section view of FIG. 9.

FIGS. 8 through 10 illustrate selective adjustable alignment means failure before a predetermined number of contactor operations as contactor components are attempting to move from the open to the closed position. In particular, these figures illustrate the failure of nose stud 80 with the consequent rotation of slider bar 32 which results in interlock tab 72 being received in arrestor notch 48 to prevent the slider bar 32 from moving between an interlock open position shown in FIG. 7 to an interlock closed position shown in FIG. 4 and the consequent closure of contact 20.

The views shown are to a degree symbolic and intended to illustrate the functional relation among the armature actuator, interlock means for selectively preventing movement of the armature, arresting means for selectively preventing movement of the interlock means, and selective adjustable alignment means for aligning the interlock means and arresting means and for failing before a predetermined number of contactor operations, rather than the operation of the contactor components alone, which is well known in the art.

FIG. 3 is intended to illustrate slider bar 32 at its limit of travel to the interlock closed position shown by close arrow 104 following movement of armature actuator 30 in the direction of armature close arrow 106. As can readily be appreciated, as armature actuator moves within translation notch 34 in the direction of armature close arrow 106, slider bar 32 is prevented from moving in the same direction by nose 80 and distal 102 studs and associated structure. As a result of the angle of translation notch 34, and the restraint provided by studs 80 and 102, slider bar 32 moves in the direction of close arrow 104.

So long as clearance is maintained between interlock tab 72 and arresting notch 48 in slider bar 32, as shown in FIG. 5, and nose stud 80 is unfailed, slider bar 32 is free to reciprocate in response to the movement of armature actuator 30.

FIG. 6 and 7 illustrate the limit of reciprocation in the opposite directions with slider bar 32 having moved in the direction of open arrow 108 and armature actuator 30 having moved in the armature open position 110.

FIG. 8 illustrates the result of the shearing of nose stud 80 as a result of the designed weakening introduced by circumferential groove 94. As perhaps better seen in FIG. 9 and 10, the ultimate result of the shearing of nose pin 80 is the reception of interlock tab 72 in arresting notch 48 following the pivoting of slider bar 32 about distal stud 102 in the rotational direction shown by shear arrow 112 as armature actuator 30 moves in the armature closed direction of arrow 106. Slider bar 32 both translates towards in the close direction of arrow 104, and rotates in the direction of arrow 112 until interlock tab 72 is received within arrestor notch 48, preventing the slider bar 32 from moving from the interlock open to the interlock close positions.

Once tab 72 is received in notch 48, armature actuator 30 is restrained from further movement and thereby preventing the armature 22 from moving between an armature open to an armature closed position. As a result, contacts 20 are prevented from moving between a contact open and a contact closed position.

Slider bar 32 acts as interlock means operationally connected to the armature actuator 30 for selectively preventing the movement of the armature.

Arresting plate 62, is operatively connected with slider bar 32 through interlock tab 72 to prevent movement slider bar 32 and thereby acts as arresting means.

Arresting plate 62, particularly arresting abutment 76 with base abutment 84 and adjustment shaft 82, act as selective adjustable means for aligning slider bar 32 and interlock tab 72. Distal 102 and nose 80 studs received in distal 44 and nose 46 notches act as selective alignment means for aligning the interlock means and the arresting means and for failing before a predetermined number of contactor operations.

Following failure of nose stud 80, acting as fallible alignment means, detachable mounting base 58 can be removed. This also removes the interlock means, arresting means and selective adjustable and alignment means as a unit for replacement with other associated components to assist in more reliable operation of all interlocks associated with interlocked contactor assembly 10.

As those skilled in the art will readily recognize, some of the invention elements may be interchanged, for example those shown as integral may be separated or those separated may be made integral without adversely affecting the performance of the invention. Similarly, rotational and translational movement can be equivalent to achieve the same end. In particular contactor contacts may be arranged in a normally open or normally closed position with an appropriate reversal of contactor components. Similarly, as in commercial embodiments, arresting notch 48 may face the front of the contactor with an appropriate reversal of associated components.

From the foregoing description it will be apparent that modifications can be made to the interlocked contactor assembly of the present invention without departing from the teaching of the invention. Also, it will be appreciated that the invention has a number of advantages, some of which have been described above and others of which are inherent in the invention. Accordingly, the scope of the invention is only to be limited as is necessitated by the accompanying claims.

We claims

1. An interlocked contactor assembly for a power center comprising:

a contactor frame;

at least one contact for conducting current in a contact closed position and for preventing conduction of current in an contact open position, said at least one contact operatively mounted to said contactor frame;

an armature mounted on said contactor frame having an armature closed position and an armature open position, said armature operatively connected to said at least one contact to move said contact between said closed and open positions corresponding to armature closed and open positions;

an armature actuator operatively connected to said armature and having an actuator closed and open positions corresponding to said armature closed position and said armature open position;

interlock means operatively connected to said armature actuator for selectively preventing movement of said armature from said armature open position to said armature closed position, said interlock means having an interlock open position and an interlock closed position corresponding to said armature closed position and said armature open position;

arresting means operatively connected with said interlock means for selectively preventing movement of said interlock means from said interlock open position to said interlock closed position; and selective adjustable alignment means for aligning said interlock means and said arresting means and for failing before a predetermined number of contactor operations, said adjustable alignment means operatively connected to said interlock means and said arresting means and causing interference preventing said interlock means from moving from said interlock open position to said interlock closed position on failure of said adjustable alignment means.

2. The contactor assembly of claim 1 further including:

a mounting base detachably mounted to said contactor frame; and wherein;

said interlock means, said arresting means, and said selective adjustable alignment means are connected to said mounting base and form a detachable interlock assembly removable from the remainder of the contactor assembly as a unit.

3. The contactor assembly of claim 2 wherein:

said selective adjustable alignment means includes;

fallible alignment means which fails to preserve alignment between said interlock means and said arresting means causing said arresting means to prevent said interlock means moving from said interlock open position to said interlock closed position which failure to preserve alignment occurs before a preselected number of contactor operations.

4. The contactor assembly of claim 3 wherein:

said adjustable alignment means in an unfailed condition restrains relative movement between said interlock means and said arresting means to one degree of freedom and in a failed condition allows initial relative movement between said interlock means and said arresting means in more than one degree of freedom before interference between said interlock means and said arresting means prevents said interlock means from moving between said interlock open position and said interlock closed position.

5. The contactor assembly of claim 4 wherein:

said interlock means includes an arresting notch;

said arresting means is pivotally mounted for rotational movement with respect to said base and includes an interlock tab which is received by said arresting notch following failure of said adjustable alignment means; and said adjustable alignment means includes an adjustment means which selectively causes rotation of said arresting means for adjusting and maintaining the degree of clearance between said arresting notch and said interlock tab before failure of said adjustable alignment means occurs.

6. The contactor assembly of claim 5 wherein:

said armature actuator moves between said actuator closed position and said actuator open position with a single degree of freedom;

said adjustable alignment means includes, a first orientation means for guiding movement of said interlock means;

a second orientation means for guiding movement of said interlock means located at some distance from said first orientation means;

said interlock means includes, translation means for tending to cause said interlock means to move with more than one degree of freedom which is restricted to one degree of freedom by said adjustable alignment means in an unfailed condition in response to movement of said armature actuator, and for causing said interlock means to move with more than one degree of freedom and said interlock tab to be received by said arresting notch when said armature actuator attempts to move from said actuator open to said actuator closed position on failure of one of said first and said second orientation means.

7. The contactor assembly of claim 6 wherein, said interlock means includes, a slider bar being generally elongate and having a distal end and a nose end, and including a distal elongate notch adjacent said distal end, a nose elongate notch adjacent said nose end, each elongate notch elongate in the same direction as said slider bar, and an elongate translation notch at an angle to said elongation of said slider bar, said translation notch receiving said armature actuator and acting as translation means;

said first orientation means including a distal stud mounted to said base and partially received within said distal notch;

said second orientation means including a nose stud mounted to said base and partially received within said nose notch;

whereby failure of one of said studs allows said slider bar to pivot about the remaining stud as well as translate with respect to said stud and thereby cause said arresting notch to interfere with said interlock tab as said armature actuator attempts to move from said actuator open to said actuator closed position.

8. The contactor assembly of claim 7 wherein:

said arresting means includes an arresting plate being a generally flat parallelepiped arresting base which has an arresting pivot structure adjacent a corner of said arresting base and said interlock tab projects upward from said arresting base on a side of said parallelepiped not forming the corner adjacent said pivot structure; and said slider bar has said translation notch between said distal notch and said nose notch and said arresting notch is between said nose notch and said nose end.

9. The contactor assembly of claim 8 wherein said adjustable alignment means further includes:

a base abutment mounted to said base;

an arresting abutment mounted to said arresting base; and an adjustment shaft extending between said base and arresting abutments having an effective length determining the distance between said base and arresting abutments and thereby determining the degree of clearance between said arresting notch and said interlock tab.

10. The contactor assembly of claim 9 wherein:

each of said distal and nose studs include a roller rotatingly mounted on said stud, each said roller being partially received within each said distal and nose notches to orient said slider bar and having a roller diameter somewhat less than a width of said notch.

11. The contactor assembly of claim 10 wherein one of said studs has an associated circumferential groove in the region of said roller which will cause one of said studs to fail to provide support to said roller before a predetermined number of operations of said contactor preventing said slider from moving from said interlock open to said interlock closed positions.

12. An interlocked contactor assembly comprising:

a contactor including;

a contactor frame, contactor contacts having an contact open position and a contact closed position, and an armature causing the contactor contacts to move between contact closed and contact open positions by moving between corresponding armature closed and armature open positions; and an interlock mechanism which selectively causes said assembly to fail by preventing closure of contactor contacts before a preselected number of operations of said contactor, said interlock mechanism including, interlock means operatively connected to said armature for selectively preventing movement of said armature from said armature open position to said armature closed position, said interlock means having an interlock open position and an interlock closed position corresponding to said armature closed position and said armature open position;

arresting means operatively connected with said interlock means for selectively preventing movement of said interlock means from said interlock open position to said interlock closed position; and selective adjustable alignment means for aligning said interlock means and said arresting means and for failing before a predetermined number of contactor operations, said adjustable alignment means operatively connected to said interlock means and said arresting means and causing interference preventing said interlock means from moving from said interlock open position to said interlock closed position on failure of said adjustable alignment means, said selective adjustable alignment means in an unfailed condition restraining relative movement between said interlock means and said arresting means to one degree of freedom and in a failed condition allowing initial relative movement between said interlock means and said arresting means in more than one degree of freedom before interference between said interlock means and said arresting means prevents said interlock means from moving between said interlock open position and said interlock closed position.

13. The contactor assembly of claim 12 further including:

a mounting base detachably mounted to said contactor frame; and wherein;

said interlock means, said arresting means, and said selective adjustable alignment means are connected to said mounting base and form a detachable interlock assembly.

14. The contactor assembly of claim 13 wherein:

said selective adjustable alignment means includes;

fallible alignment means which fails to preserve alignment between said interlock means and said arresting means causing said arresting means to prevent said interlock means moving from said interlock open position to said interlock closed position which failure to preserve alignment occurs before a preselected number of contactor operations.

15. The contactor assembly of claim 14 wherein said interlock means includes:

translation means for tending to cause said interlock means to move with more than one degree of freedom which is restricted to one degree of freedom by said adjustable alignment means in an unfailed condition in response to movement of said armature, and for causing said interlock means to move with more than one degree of freedom and said interlock means to be prevented from moving from said interlock open to said interlocked closed positions when said armature attempts to move from said actuator open to said actuator closed position on failure of said fallible alignment means.

16. The contactor assembly of claim 15 wherein said fallible alignment means in an unfailed condition structurally opposes the effect of said translation means to move with more than one degree of freedom, said fallible alignment means including a designed weakening of structure causing said failure means to fail before a predetermined number of contactor operations.

17. The contactor assembly of claim 16 wherein said fallible alignment means includes an elongate stud with a circumferential groove which is designed to cause failure of said stud before a predetermined number of contactor operations.

18. The contactor assembly of claim 16 wherein said fallible alignment means is designed to fail catastrophically.

19. An interlocked contactor assembly comprising:

a contactor including;

a contactor frame, contactor contacts, and an armature causing the contactor contacts to move between contact closed and contact open positions; and an interlock mechanism which selectively causes said assembly to fail by preventing closure of contactor contacts before a preselected number of operations of said contactor, said interlock mechanism including;

an armature actuator connected to said armature, a detachable mounting base detachably mounted to said contactor frame and supporting other components of said interlock mechanism, said base allowing the removal of said interlock mechanism as a unit excepting said armature actuator, a slider bar having an arresting notch and moving between an interlock open and interlock closed position corresponding to the contact open and contact closed positions in response to the action of the armature actuator riding in a translation notch of said slider bar, a pair of roller carrying studs, one of which is designed to shear before the predetermined number of contactor operations positionally maintaining said slider bar before the failure of said assembly by shear of said one stud, when both studs are in an unfailed condition, said studs causing said slider bar to only translate as a result of the movement of said armature actuator, on failure of one of said studs, said slider bar both rotates and translates causing said arresting notch to receive a interlock tab when the contactor attempts to close, an arresting base pivotally mounted for movement about one of said studs providing adjustable alignment with said slider bar, said arresting base having an arresting abutment and said interlock tab, a base abutment mounted on said detachable mounting base, and an adjustment shaft extending between said arresting abutment and said base abutment to determine the degree of clearance between said interlock tab on said arresting base and said arresting notch on said slider bar.

* * * * *